US005890381A

United States Patent [19]

Leeke et al.

[11] Patent Number: 5,890,381

[45] Date of Patent: Apr. 6, 1999

[54] KNITTED UPHOLSTERY FABRIC WITH TUBULAR FASTENING PORTIONS

[75] Inventors: Gary John Leeke, Sterling Heights; Debra Jean Tiensivu, Clinton Township, Macomb County, both of Mich.

[73] Assignee: Lear Corporation, Southfield, Mich.

[21] Appl. No.: 958,962

[22] Filed: Oct. 28, 1997

[51] Int. Cl.[6] ..... D04B 1/22

[52] U.S. Cl. ..... 66/170; 297/218.1; 297/226; 66/172 R

[58] Field of Search ..... 297/218.5, 218.1, 297/226; 66/172 R, 170; 38/140; 428/193

[56] References Cited

U.S. PATENT DOCUMENTS

| | | | |
|---|---|---|---|
| 500,269 | 6/1893 | O'Brien | 66/172 |
| 1,206,171 | 11/1916 | Thierfelder | 66/172 |
| 1,681,179 | 8/1928 | Fry | 297/418.5 |
| 2,801,682 | 8/1957 | Fridolph | 155/185 |
| 2,811,199 | 10/1957 | Morrill et al. | 155/182 |
| 3,152,835 | 10/1964 | McKie | 297/423 |
| 3,602,012 | 8/1971 | Burleson | 66/172 |
| 3,801,154 | 4/1974 | Hultquist et al. | 297/218 |
| 3,807,200 | 4/1974 | Liwski | 66/117 |
| 4,872,324 | 10/1989 | Rearwin et al. | 66/172 |
| 5,215,807 | 6/1993 | Day et al. | 428/193 |
| 5,308,141 | 5/1994 | Robinson et al. . | |
| 5,326,150 | 7/1994 | Robinson et al. . | |
| 5,428,969 | 7/1995 | Day et al. . | |

*Primary Examiner*—Andy Falik
*Attorney, Agent, or Firm*—Brooks & Kushman P.C.

[57] ABSTRACT

A three-dimensional continuously knitted fabric cover knitted from yarn in a generally double jersey construction for covering a three-dimensional core, the fabric cover having an exposed front layer with a rear layer adjacent the core, the cover having a tubular portion which has loose knit attachment zones for receiving hog rings when the cover is secured to a seat frame or support.

5 Claims, 3 Drawing Sheets

KNITTED UPHOLSTERY FABRIC WITH TUBULAR FASTENING PORTIONS

TECHNICAL FIELD

This invention relates to upholstery fabrics intended in use to cover at least part of the surface of a three-dimensional structure, and in particular but not exclusively to upholstery for seats, especially vehicle seats.

BACKGROUND OF THE INVENTION

Three-dimensional fabric covers for seats have in the past been produced from woven or knitted fabric which has been cut into shaped panels which are then sewn together.

More recently, it has been found possible to continuously knit one-piece three-dimensional upholstery fabric covers, which removes the need for cutting and sewing, and has the desired shape to serve as covers for the back and base cushions of motor vehicle seats; see, for example, U.S. Pat. Nos. 5,308,141 and 5,326,150.

It is necessary to provide anchorage devices at the edges of the covers to enable the covers to be secured to a support and held tautly over their respective cushions. The anchorage devices typically take the form of tubular portions or flaps which may be formed by sewing or by integrally knitting said portions. The tubular portions accommodate rods which are recessed into the cushions and secured under the support. If the base and back cushions comprise bolsters, it may also be necessary to provide anchorage devices on the undersurface of the cover in order to conform the cover to the shape of the upper surface of the cushion. The anchorage devices are typically open-ended tubular flaps which are formed by sewing or integral knitting as shown in U.S. Pat. Nos. 5,308,141 and 5,326,150. In some applications, metal rods are inserted into the tubular flaps, and the metal rod and flap are secured to the seat frame by hog rings which pass around the metal rod. Typically the tubular flap may have apertures therein to allow access for the hog rings. In other cases, the hog rings may pass through the fabric of the flap.

For continuously knitted 3-D covers, the provision of apertures in the flaps is a relatively slow operation, but if such apertures are not provided the operator may inaccurately position the hog ring so that tensions in the taut cover are not taken by the metal rod but by the fabric itself. This is manifested as a surface dimpling or dipping along the exposed seam where the tension loads are transmitted to the face side of the cover.

SUMMARY OF THE INVENTION

According to the invention, there is provided an upholstery fabric cover, machine knitted from yarn formed into stitches arranged in courses and wales, for covering at least in part a three-dimensional core, the fabric cover having a knitted tubular portion formed therewith which serves as an anchorage device for facilitating the securing of the cover to a support, the tubular portion having designated anchorage zones for the attachment of securing devices, wherein the fabric of the tubular portion at least in said designated zones has a looser stitch structure than the rest of the fabric.

Preferably, the cover is of a generally double jersey knitted fabric having a front layer and a rear layer, and the knitted tubular portion is a flap which includes single jersey portions formed in the rear layer only.

The cover is preferably a three-dimensional, continuously knitted cover.

The tubular flap may be a course-wise extending flap that is integrally knitted with the double jersey fabric.

In another embodiment the flap is a wale-wise extending flap which is formed in the fabric by gathering fabric and sewing.

Also according to the invention, there is provided a method of manufacture of a machine knitted upholstery fabric from at least one yarn for covering at least in part the surface of a three-dimensional core, the fabric being knitted with a portion for forming a tubular flap which serves as an anchorage device for facilitating the securing of the cover to a support, wherein the tubular flap is knitted with at least a zone in which the yarn is knitted with a looser stitch structure than the rest of the tubular portion, to form in use an attachment zone for securing the cover to the support.

Preferably the fabric is of a generally double jersey construction and is knitted on a flat "V" bed knitting machine having a front bed for knitting the front layer of the fabric and a rear bed for knitting the rear layer of the fabric, the method including knitting a substantially double jersey fabric on both needle beds with the zones of looser stitch structure of the tubular flap being knitted on the rear needle bed only.

For a cover having a course-wise extending tubular flap wherein the double jersey fabric is knitted on both needle beds up to a predetermined course, whereafter the front needle bed is held up and knitting continues on a selected group of needles on the rear needle bed for a desired number of courses, selected needles in at least one sub-group within the group are then pressed off, and knitting continues on the operative needles on the rear bed for a desired number of courses to form a zone of looser structure. Knitting then recommences on all needles on the rear bed within the selected groups for a determined number of courses, and thereafter knitting recommences on all needles on both beds.

For a cover having a wale-wise extending tubular flap, the double jersey fabric is knitted on both needle beds up to a predetermined course, whereafter a selected group of needles on the front needle bed are pressed-off and knitting thereafter continues on both needle beds, except within the selected group in which only the rear bed needles are operative up to a second predetermined course, whereafter knitting resumes on both needle beds, the tubular flap being formed by gathering the fabric knitted on said selected group and sewing.

Preferably, the fabric is knitted on a machine having seven to 14 needles per inch, and preferably 12 needles per inch. The double jersey fabric is knitted from at least one yarn which is preferably air textured polyester yarn having a decitex in the range of 500–800 decitex, or could be chenille yarn of the type disclosed in U.S. Pat. No. 5,428,969 which has a ground yarn with a count in the range 550–900 decitex and a chenille yarn having a decitex in the range of 1700–5000.

Yet another aspect of the invention provides a method of securing a knitted fabric cover to a core, the cover having a tubular flap that serves as an anchorage device for facilitating the securing of the cover to a support, whereby in order to reduce visual surface defects in the cover the flap is provided with attachment zones having a looser knit structure than the general structure of the flap, securing means anchoring the flap to the support being passed through the attachment zones.

The cover is preferably for a motor vehicle seat cushion or back.

BRIEF DESCRIPTION OF THE DRAWINGS

This invention will be described by way of example and with reference to the accompanying drawings in which.

DESCRIPTION OF THE PREFERRED EMBODIMENT

Figure 1:
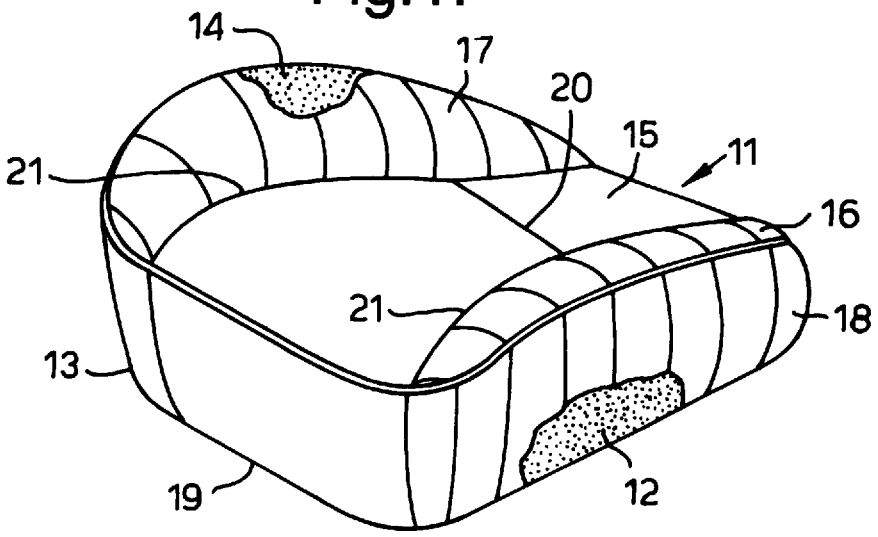
FIG. 1 is an isometric view of an upholstered automobile seat cushion.
Figure 2:
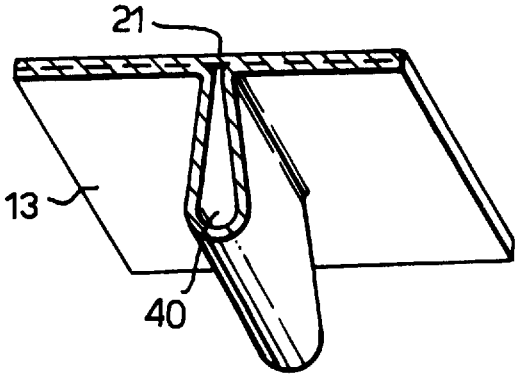
FIG. 2 is a cross-sectional view through a cover and a first type of anchorage flap.

Referring to FIG. 1, this shows an isometric view of a seat cushion 11 having a foam core 12 covered by a double jersey knitted fabric cover 13. The foam core 12 may be of any desired shape and, as shown in the present example, has wings 14 and is typically mounted on a metal frame to which the cover 13 is secured to hold the cover tautly against the surface of the core.

The fabric cover 13 is continuously knitted in three dimensions on a flat "V" bed knitting machine having independently operable needle beds. The cover 13 may comprise a central panel 15, side wings 16 and 17, a base and integrally knitted edge members 18 and 19 which are secured to the frame. The cover 13 includes decorative seams 20 and 21. Such covers are typically used in vehicle seats.

In order that the invention can be more fully understood, details of flat "V" bed machines are to be found in the publication "Dubied Knitting Manual" published by Eduoard Dubied et Cie SA, Neu Chatel, Switzerland in 1967. Flat "V" bed knitting machines are very well known, and many such machines are now computer controlled. It has recently been proposed to manufacture upholstery fabric on such machines (see, for example, U.S. Pat. Nos. 5,308,141 and 5,326,150), such fabrics being suitable for use in vehicle upholstery.

The knitting of a fabric by the method according to the invention uses a Stoll CMS machine with 12 gauge needles. This machine is a flat "V" bed machine provided with a loop hold down device, such as a presser foot or sinker, to assist take-down of knitted fabric. The machine can operate with a plurality of yarn feeds, each of which is associated with a respective cam box. The cam box traverses across the needle beds with yarn carriers supplying yarn to the needles as is desired in each direction of travel.

The fabric cover is a double jersey weft knitted structure. Essentially such a double jersey structure comprises a pair of single jersey fabric layers formed of interconnected loops or stitches of yarn wherein the opposing pairs of layers are interconnected by further loops of yarn. It is possible to produce highly complex designs on the fabric structure by automatically controlling the operation of the needles, particularly where two or three colors of yarn are used. Normally, such fabrics would be knitted with a jacquard knitting machine in which the colors of the face of the fabric can be determined by suitable needle selection.

Conveniently, it is only the technical face of the fabric which is of an attractive appearance. The technical reverse face, either being covered by a reinforcing or padding layer, or being in direct contact with the core 12, is of no particular interest to the eventual end user.

The fabric cover 13 is a double jersey weft knitted structure having a technical face effectively comprising a series of loops in a front layer of fabric formed on one bed of the knitting machine, and a technical reverse or rear face is formed by a series of loops in a rear layer of fabric formed on the second needle bed of the knitting machine.

The cover 13 requires pulling down and holding tautly against the surface of the foam core. This also prevents shuffling of the cover on the core. The cover 13 is held in tension by anchorage devices, generally tubular portions of fabric which may be knitted integrally with the cover 13 or formed by a sewing operation.

In particular, the decorative seams 20 are arranged in a wale-wise direction relative to the knitted fabric cover and may be held down by a tubular flap 50 (see FIG. 3) formed by gathering knitted fabric into a tube and sewing along a seam 57 at the root of the flap. The cover 13 is secured to a support by means of metal rods or wires 58 which are located in the tubular flap 50 and which are secured to a support 60, such as a seat frame, by hog rings 59.

Figure 3:
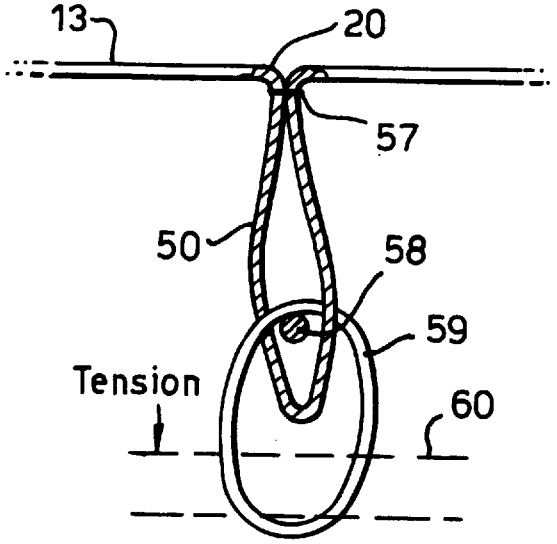
FIG. 3 is a cross-sectional view through a cover and second type of anchorage flap.

The decorative seams 21 extend in a course-wise direction of the fabric cover 13 and are held down by a tubular flap 40, again using wire rods and hog rings as described with reference to FIG. 3. In this case, the flap 40 is integrally knitted with the cover as will be described.

Figure 5:
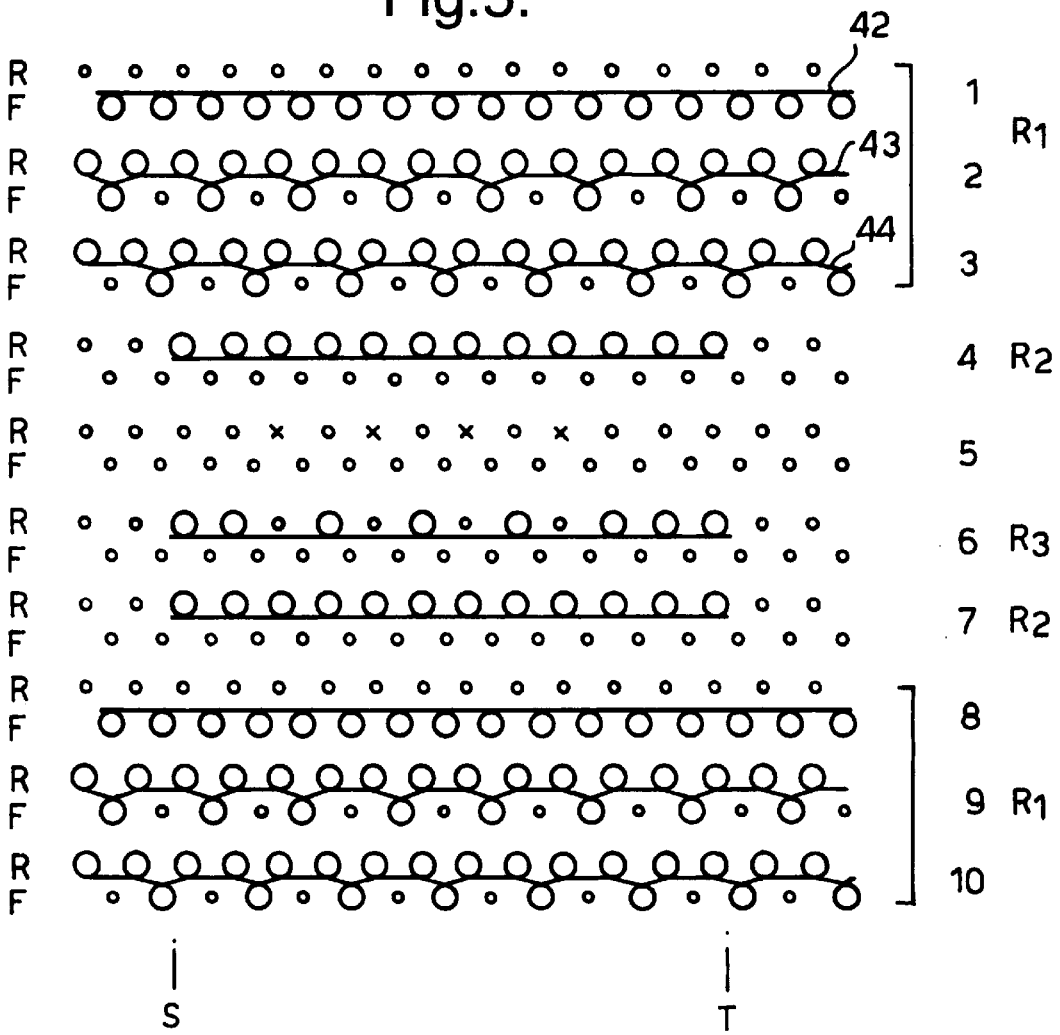
FIG. 5 is a knitting diagram showing the stitch structure for knitting the flap of FIG. 4.
Figure 8:
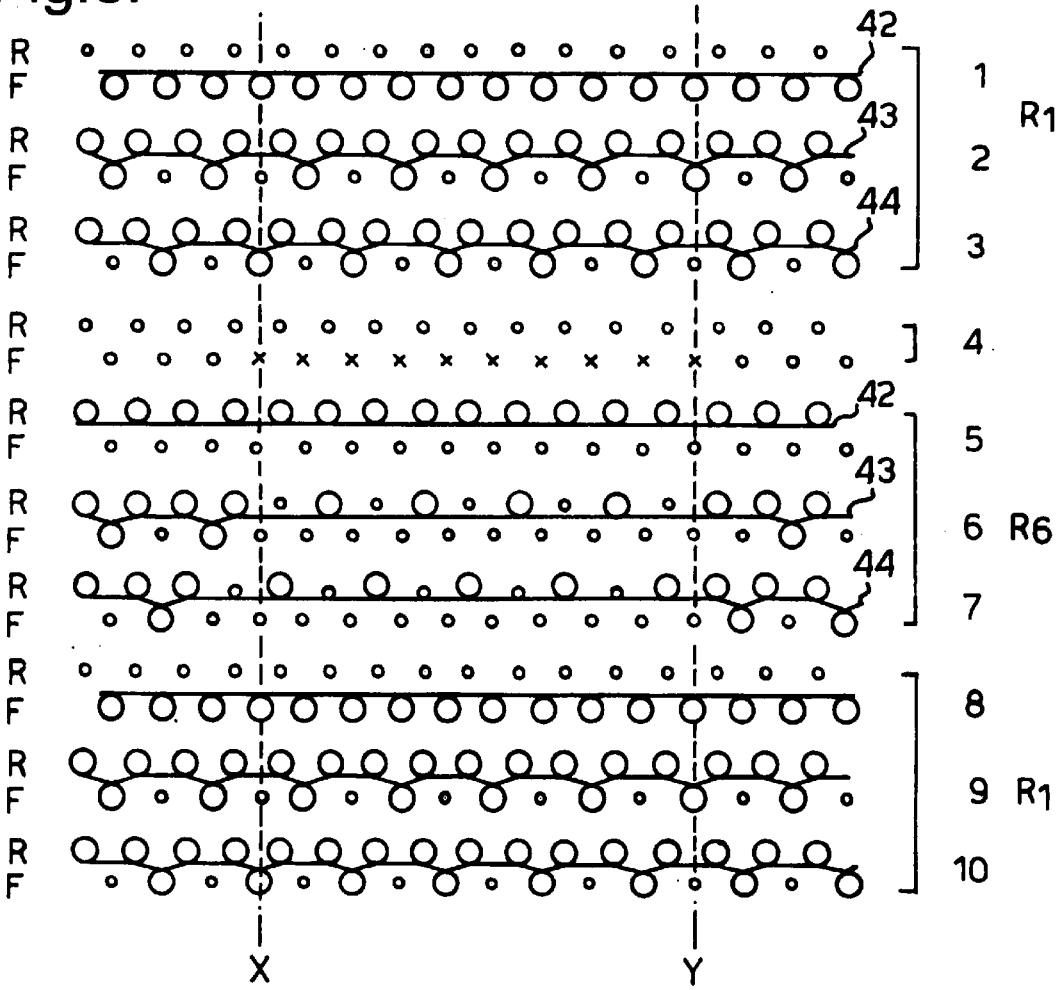
FIG. 8 is a knitting diagram showing the stitch structure for knitting the flap of FIG. 7.

Referring to FIGS. 5 and 8, there are shown stitch diagrams in which each row represents a row of knitting on one yarn pass of the carrier. In each row the upper line of small dots represents individual needles on the rear needle bed (R) of a knitting machine, and the lower row of dots represents the needles of the front bed (F) of the knitting machine. In the terminology used herein, the front layer of the fabric 13 is knitted on the front needle bed and the rear layer of the fabric is knitted on the rear needle bed. The yarn is represented by loops and interconnecting cross-links. It will be appreciated that the stitch diagrams represent only a small portion of the cover as is required for illustrating the invention.

Figure 4:
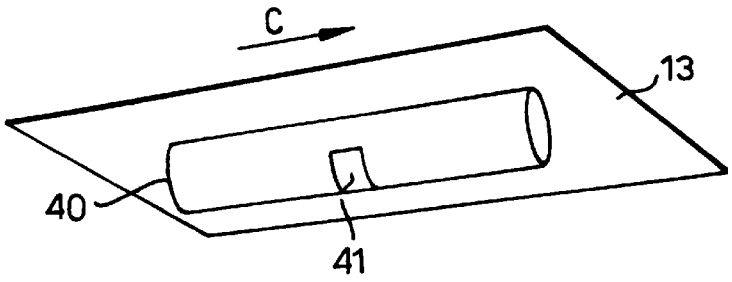
FIG. 4 is an isometric view of a fabric piece and a first anchorage flap according to the invention.

Referring to FIG. 4, there is shown a portion of a knitted fabric cover 13 having a flap 40 extending in a course wise direction C of the fabric. The flap 40 has a zone of weakness 41, in this case a loose knitted zone, for accommodating a hog ring for securing the cover to a support.

The method of knitting the fabric and flap 40 is shown in FIG. 5. The rows 1 to 3 represent a repeat unit R1 for producing a double jersey fabric knitted from three yarns 42, 43, 44. The yarn 42 may be a chenille yarn and the yarns 43 and 44 may be, for example, different colored air textured polyester yarns. This repeat unit R1 is knitted as many times as is required.

At a predetermined course, all the needles on the front needle bed F are held up and knitting continues using a single ground yarn 43 or 44 which is knitted on all needles in a selected group of needles S–T, typically 170–180 needles, on the rear needle bed R to produce a single jersey flap in the rear layer of the fabric. This single jersey repeat unit R2 is repeated for a desired number of courses, e.g., 10 courses.

At row 5, within at least one sub-group of needles, preferably 8–10 needles, in the select group S–T on the rear bed R, alternate needles are pressed off. At row 6 knitting of the weakened zone 41 commences with the repeat unit R3 which may be repeated as is desired, for example, for eight to ten courses. Thereafter, at row 7 the normal single jersey repeat unit R2 is repeated as is required to finish the single jersey flap, and rows 8–10 represent the recommencement of the knitting of the double jersey structure fabric on both needle beds F and R.

Figure 6:
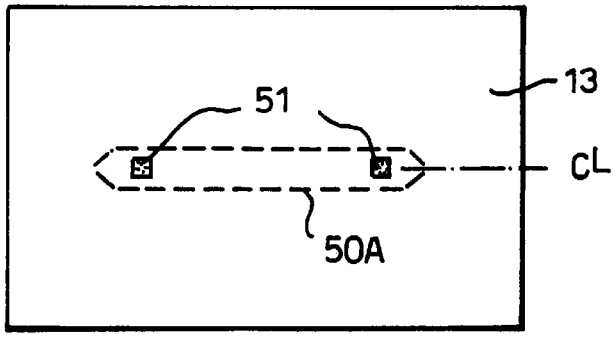
FIG. 6 shows a piece of fabric for making the flap of FIG. 7.
Figure 7:
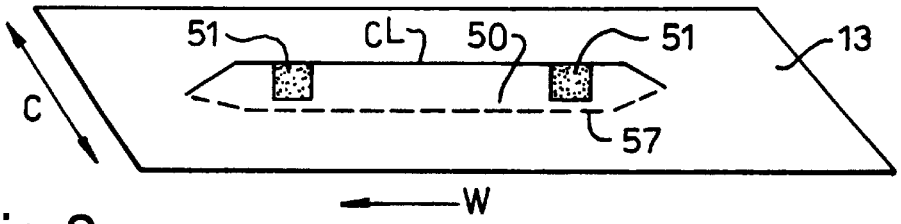
FIG. 7 is an isometric view of a fabric piece and a second anchorage flap according to the invention.

Referring to FIG. 6, there is shown a piece of fabric cover 13 having a portion of fabric 50A with two zones 51 of weakness, or loose knitted structure, formed therein. The portion of fabric 50A is shown in FIG. 7 gathered into a flap 50, extending in a wale-wise direction W of the fabric so that the center line CL of the portion 50A forms the peak CL of the flap 50. The root of the flap 50 will be sewn along the line 57 as is illustrated in FIG. 3.

With reference to FIG. 8, the three rows 1–3 illustrate the basic repeat unit R1 for the double jersey fabric as shown in FIG. 5, knitted from the three yarns 42–44 as described previously. After a desired number of courses of repeat unit R1 have been knitted, a select group of needles X–Y on the front bed F are pressed off as is shown in row 4. Preferably, the group X–Y comprises 10 to 12 needles in width.

Knitting recommences on both needle beds as is shown in rows 5–7 to produce the repeat unit R6 and within the group X–Y no needles active on the front bed, and only alternate needles operative on the rear bed within the selected group X–Y. This produces the weakened zone and continues for about eight to ten courses. Double jersey knitting continues either side of the group X–Y.

After a desired number of courses of R6, knitting of the basic R1 repeat unit recommences as is illustrated in rows 8–10.

The weakened zones 41, 51 being of a different stitch structure to the rest of the respective flap 40, 50 are visible indicators to an operator as to where to place a hog ring 59. Further, the loose knit structure through which the hog rings pass is capable of distortion such that if a hog ring is incorrectly located relative to a wire rod 58, the zone distorts to allow the ring to contact the rod but without passing tensions back to face side of the cover.

We claim:

1. An upholstery fabric cover machine knitted from yarn formed into stitches arranged in courses and wales for covering at least in part a three-dimensional core, the fabric cover having a knitted tubular portion formed therewith which serves as an anchorage device for facilitating the securing of the cover to a support, the tubular portion having designated anchorage zones for the attachment of securing devices, wherein the fabric of the tubular portion at least in said designated zones has a looser stitch structure than the rest of the fabric.

2. A cover as claimed in claim 1, wherein the tubular portion extends in a course-wise direction of the fabric.

3. A cover as claimed in claim 2, wherein the tubular portion is integrally knitted into the front layer of the double jersey fabric.

4. A cover as claimed in claim 1, wherein the tubular portion extends in a wale-wise direction of the fabric.

5. A cover as claimed in claim 4, wherein there is a plurality of course-wise spaced anchorage zones in said tubular portion.

* * * * *